US007007886B2

(12) United States Patent
Oesterwind et al.

(10) Patent No.: US 7,007,886 B2
(45) Date of Patent: Mar. 7, 2006

(54) YARN WINDING SPINDLE

(75) Inventors: Roland Oesterwind, Remscheid (DE); Rainald Voss, Wermelskirchen (DE); Heinz Jäschke, Radevormwald (DE); Roland Kampmann, Witten (DE); Jorg Spahlinger, Wermelskirchen (DE)

(73) Assignee: Saurer GmbH & Co. KG, Monchengladbach (DE)

( * ) Notice: Subject to any disclaimer, the term of this patent is extended or adjusted under 35 U.S.C. 154(b) by 0 days.

(21) Appl. No.: 10/863,548

(22) Filed: Jun. 8, 2004

(65) Prior Publication Data

US 2004/0222328 A1 Nov. 11, 2004

Related U.S. Application Data

(63) Continuation of application No. PCT/EP02/14213, filed on Dec. 13, 2002.

(30) Foreign Application Priority Data

Dec. 22, 2001 (DE) ..... 101 63 832

(51) Int. Cl.
*B65H 54/54* (2006.01)

(52) U.S. Cl. ..... 242/573.7; 242/573.3; 242/576.1

(58) Field of Classification Search ..... 242/573.1, 242/573.3, 573.4, 573.7, 576.1, 130
See application file for complete search history.

(56) References Cited

U.S. PATENT DOCUMENTS

| | | | | |
|---|---|---|---|---|
| 4,336,912 A | | 6/1982 | Greb | |
| 4,784,343 A | * | 11/1988 | Mutter et al. | 242/571.8 |
| 4,811,910 A | * | 3/1989 | Busenhart et al. | 242/597.3 |
| 5,217,175 A | | 6/1993 | Stitz et al. | |
| 5,360,182 A | * | 11/1994 | Badiou | 242/573.7 |
| 6,113,025 A | * | 9/2000 | Kudrus | 242/573.7 |

FOREIGN PATENT DOCUMENTS

| | | |
|---|---|---|
| CH | 511 238 A5 | 10/1975 |
| DE | 25 28 384 A1 | 1/1977 |
| DE | 30 44 315 A1 | 10/1981 |
| DE | 196 07 916 A1 | 9/1996 |
| DE | 195 48 142 A1 | 6/1997 |
| DE | 100 37 201 A1 | 2/2001 |
| EP | 0 234 844 B2 | 9/1987 |
| EP | 0 363 227 B1 | 4/1990 |
| EP | 0 704 400 A2 | 4/1996 |

* cited by examiner

*Primary Examiner*—Kathy Matecki
*Assistant Examiner*—Evan H. Langdon
(74) *Attorney, Agent, or Firm*—Alston & Bird LLP

(57) ABSTRACT

A winding spindle for mounting a plurality of yarn winding tubes, and which is formed by an inner tube and an outer tube surrounding the inner tube. The inner tube connects to a drive shaft. Between the inner tube and the outer tube, a clamping device is arranged, which comprises a plurality of clamping elements which extend through openings of the outer tube for mounting the winding tubes. The outer tube extending on the circumference of the inner tube is stayed by a plurality of support members that are arranged in an axially spaced apart relationship between the inner tube and the outer tube. To this end, the support members produce a radially acting clamping force between the inner tube and the outer tube.

11 Claims, 5 Drawing Sheets

YARN WINDING SPINDLE

CROSS REFERENCE TO RELATED APPLICATION

The present application is a continuation of international application PCT/EP02/14213, filed 13 Dec., 2002, and which designates the U.S. The disclosure of the referenced application is incorporated herein by reference.

BACKGROUND OF THE INVENTION

The present invention relates to a winding spindle for mounting a plurality of winding tubes on a yarn winding machine. A winding spindle of this general type is disclosed in DE 196 07 916 A1.

Winding spindles of this type are used in winding or takeup machines for winding freshly spun synthetic filament yarns to packages. To this end, a plurality of winding tubes are mounted, one after the other, on the winding spindle that is projectingly arranged in the takeup machine. For mounting the winding tube, the winding spindle possesses a clamping device that includes a plurality of clamping elements, which are adapted for extending radially outward. For receiving the clamping device, an annular space is formed between an outer tube and an inner tube.

The inner tube connects to a drive shaft for transmitting the rotational motion, and the outer tube is coupled with the inner tube in a substantially formfitting manner, with the load capacity of the winding spindle being defined by the inner tube. As a result, the known winding spindle has a relatively small, bending-critical natural frequency. To realize high yarn speeds of more than 4,000 m/min, the winding spindle must operate as a function of the package diameter in a speed range from about 2,000 to 22,000 rpm while winding the yarns. In this process, the natural frequencies of the winding spindle represent to a certain extent critical speeds, which lead to resonance vibrations. It is therefore desired to design the winding spindle in such a manner that it reaches a natural frequency that is as high as possible. In this connection, however, it is necessary to maintain the inside diameters of the tubes being mounted as the extreme limit values for the configuration of the winding spindle.

EP 0 704 400 discloses a winding spindle wherein the outer tube is constructed as a supporting element and coupled with a drive. Winding spindles of this type, however, have in general the disadvantage that the connection to a drive must be initiated at the end of the outer tube because of the internally arranged clamping device. With that, high torsional moments are additionally introduced into the outer tube. This requires an additional torsional rigidity besides the desired high flexural strength.

It is therefore an object of the invention to further develop a winding spindle of the initially described type in such a manner that the natural frequency of the winding spindle is increased to a substantial extent.

SUMMARY OF THE INVENTION

The above and other objects and advantages of the present invention are achieved by the provision of a winding spindle which comprises a rotatable inner tube, an outer tube coaxially surrounding the inner tube, a clamping device which includes a plurality of clamping elements for radially engaging the interior of the yarn winding tubes which are coaxially mounted on the spindle, and a plurality of axially spaced apart support members arranged between the inner and outer tubes for producing a radially operative clamping force between the tubes of the spindle.

The invention has the advantage that while the arrangement of the outer tube, clamping device, and inner tube remains unchanged, the diameter of the winding spindle that is decisive for the load capacity and natural frequency is enlarged. To this end, the outer tube and the inner tube are stayed with each other such that the outer tube and the inner tube absorb the expected external load to the same extent. To this end, a plurality of support members are axially arranged in spaced relationship between the inner tube and the outer tube. The support members produce a radially operative clamping force between the inner tube and the outer tube, so that a frictional engagement results between the inner tube and the outer tube. With that, it becomes possible to use besides the inner tube, the external outer tube for absorbing the load during the entire operation of the winding spindle.

To avoid on the one hand that centrifugal forces discontinue the frictional engagement of the inner tube and the outer tube, and to obtain on the other hand a clamping force that is uniformly operative between the outer tube and inner tube over the entire circumference, the support member of an advantageous further development of the invention is configured such that over the circumference, the outer tube and the inner tube are stayed with each other at least partially in an elastic manner.

A particularly preferred further development of the invention has the advantage that the clamping force for a frictional engagement of the inner tube and outer tube is produced only after the winding spindle is assembled. To this end, the support members are each formed by a deformable support body and at least one clamping element. Thus, it is possible to arrange, for example, the not yet deformed support body on the circumference of the inner tube. The outer tube is then slipped over the inner tube and the not yet deformed support bodies. Subsequently, a clamping element is inserted or actuated to deform the support bodies in the annular space between the inner tube and the outer tube in such a manner that a radially operative clamping force builds up between the inner tube and the outer tube. However, the clamping force could also be generated in that the clamping elements leave the support body temporarily unaffected by the clamping force, and that the support bodies generate a clamping force after releasing the clamping elements. In this instance, the clamping element may be formed, for example, by an actuator or by mechanical means.

For staying the outer tube with the inner tube, the support bodies may be made both annular and segmental. In the case of annular support bodies, a clamping force is produced, which is substantially uniformly operative on the circumference between the outer tube and the inner tube. Even in the case of high clamping forces, the outer tube will maintain its predefined, preferably circular shape.

However, it is also possible to produce the clamping force between the inner tube and the outer tube via segmental support bodies. This will be of advantage in particular in the case of thick-walled outer tubes, which do not produce a measurable deformation by the operative clamping force.

A particularly simple and reliably operating variant is provided by a further development of the invention wherein the support body is held on the inner tube. To deform the support body inside the annular space between the inner tube and the outer tube, a plurality of clamping elements or screws are provided, which are evenly distributed over the circumference of the outer tube, and which act upon the support body through the outer tube. This causes the annular support body to brace itself against the outer tube and to deform, so that the outer tube is frictionally connected to the inner tube.

The support body preferably mounts on its circumference at least one elastic ring, so that a uniform support of the outer tube is maintained over the entire circumference. With that, it is further possible to produce a damping between the outer tube and the inner tube.

The ratio of the length L of the winding spindle to the diameter D of the winding spindle is above L/D>10. This makes it possible to mount safely a plurality of winding tubes in particular with a smaller diameter, as is common in the textile practice.

To accommodate a plurality of 8, 10, 12, or more winding tubes on one projecting winding spindle, and to wind in this process 8, 10, 12, or more yarns at speeds higher than 4,000 m/min, it is preferred to configure the winding spindle so that the inner tube and the outer tube extend over a length of at least one meter, with at least three support members being provided in spaced relationship for a frictional engagement of the inner tube and the outer tube.

To increase the flexural strength, it is further proposed to interconnect the outer tube and the inner tube at their free end by a cover. In this instance, the cover lies with a contact surface against the front end of the outer tube and connects by means of screws to the front end of the inner tube, thereby producing an additional staying of the outer tube with the inner tube. The axial clamping force, which is applied by the cover, ensures that the outer tube represents a unit in frictional engagement with the inner tube over the entire length.

For reliably mounting relatively wide tubes on winding spindles that project over a very great length, and for operating them at a high speed, a support point with one or more support members can be arranged respectively between two adjacent tube mounting devices of the clamping device. Thus, for each winding position, a mounting point is formed between the inner tube and the outer tube. To be able to mount and release the tubes uniformly over the entire tube width, it is preferred to use for securing the tube, the tube mounting devices that adjoin the support members. In this connection, a synchronous actuation of both tube mounting devices is of advantage.

To facilitate the assembly of the clamping device, a further advantageous embodiment of the winding spindle proposes to form the outer tube by a plurality of cylinders. In this instance, it is preferred to interconnect the cylinders rigidly. In operation, this will not substantially reduce the flexural strength when compared with a continuous outer tube, despite a plurality of cylinders. Advantageously, the cylinders are releasably joined, so that maintenance of the clamping device can be performed in a simple manner.

In the case that the outer tube is formed by cylinders only in its end regions, a bending resistant connection will not be needed.

In the case of winding spindles that project over a very great length, it has been found possible to achieve an improvement of the flexural strength in particular by reinforcing the center region. Thus, in an advantageous further development of the invention, the outer tube comprises in each of its end regions one or more externally recessed portions. With that, the wall thickness of the outer tube is greater in the center region than in the end regions. In addition, the masses of the winding spindle that are to be accelerated are reduced.

Suitable construction materials for the outer tube and the inner tube basically include steel, aluminum or, however, fiber-reinforced composite materials. To obtain a winding spindle that is as much as possible capable of bearing loads, and that is as much as possible resistant to bending, a combination of an outer tube of steel and an inner tube of aluminum or a fiber-reinforced composite has been found especially advantageous.

BRIEF DESCRIPTION OF THE DRAWINGS

Some embodiments of the winding spindle according to the invention and their advantages are described in greater detail with reference to the attached drawings, in which.

DETAILED DESCRIPTION OF THE PREFERRED EMBODIMENTS

Figure 1:
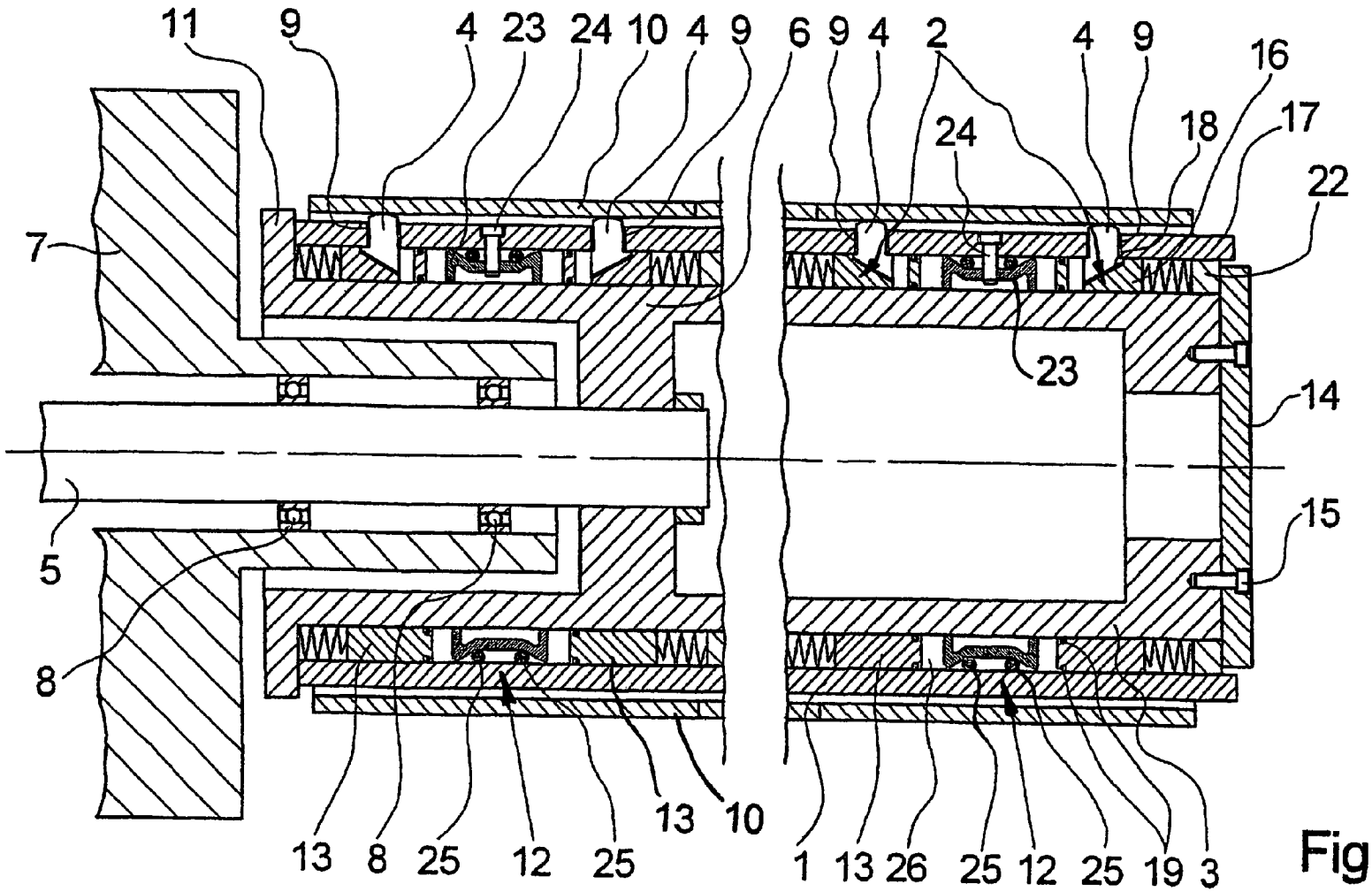
FIG. 1 is a schematic, axially sectioned view of a first embodiment of the winding spindle according to the invention.

FIG. 1 is a schematic, axially sectioned view of a first embodiment of the winding spindle according to the invention. The winding spindle possesses a drive shaft 5, which is supported in bearings 8 for rotation inside a support 7. At its end not shown, the drive shaft 5 connects to an electric drive. At its end projecting from support 7, the drive shaft 5 is coupled for corotation with a hub 6, which connects to a hollow cylindrical inner tube 3. Preferably, the hub 6 is arranged in a center region of the inner tube 3. A projecting partial length of the support 7 extends into the open end of the inner tube 3 for supporting the drive shaft 5.

On the circumference of the inner tube 3, a hollow cylindrical outer tube 1 is arranged in spaced relationship therewith, and extends substantially over the entire length of the inner tube 3. In an annular space 26 formed between the inner tube 3 and the outer tube 1, a clamping device 2 extends. The clamping device 2 consists of a plurality of tube mounting devices 13, which include a plurality of radially adjustable clamping elements 4. To this end, the clamping elements 4 extend radially outward through openings 9 of the outer tube 1 for mounting a winding tube 10 that is slipped over the circumference of the outer tube 1. The tube mounting devices 13 could be designed and constructed, for example, in the manner disclosed in DE 196 07 916 A1. Thus, the clamping element 4 is supported in the mounting device 13 at the free front end of the winding spindle via a tapered surface 18 of a piston 16 that is axially displaceable along the inner tube 3. The piston 16 is supported via one or more springs 17 on a stop 22 made integral with the inner tube 3. In its position shown in FIG. 1, the piston 16 is held by springs 17 in a clamping position. The clamping elements 4 extend from outer tube 1. To release a winding tube 10, the piston 16 is biased on its side opposite to spring 17 by a pressure medium, preferably compressed air, so that the piston is displaced against spring 17 in the direction of stop 22. This causes the tapered surface 18 to displace, so that the clamping element 4 is able to move radially inward. For sealing purposes, the piston 16 possesses on its pressure-biased side a seal 19, which produces a sealing connection respectively between the piston 16 and the inner tube 3 and between the piston 16 and the outer tube 1.

The tube mounting device 13 adjoining in the axial direction of the winding spindle is made identical, with the pressure-biased front faces of the pistons 16 facing each other in spaced relationship. With that, it is possible to mount a winding tube 10 by means of two adjacent mounting devices. To release the tube, both pistons 16 of adjacent tube mounting devices 13 are simultaneously actuated by a pressure chamber. The control means and pressure lines are not shown for the sake of clarity.

Between adjacent tube mounting devices, a support member 12 is provided in the annular space 26 between the outer tube and the inner tube 3.

Figure 2:
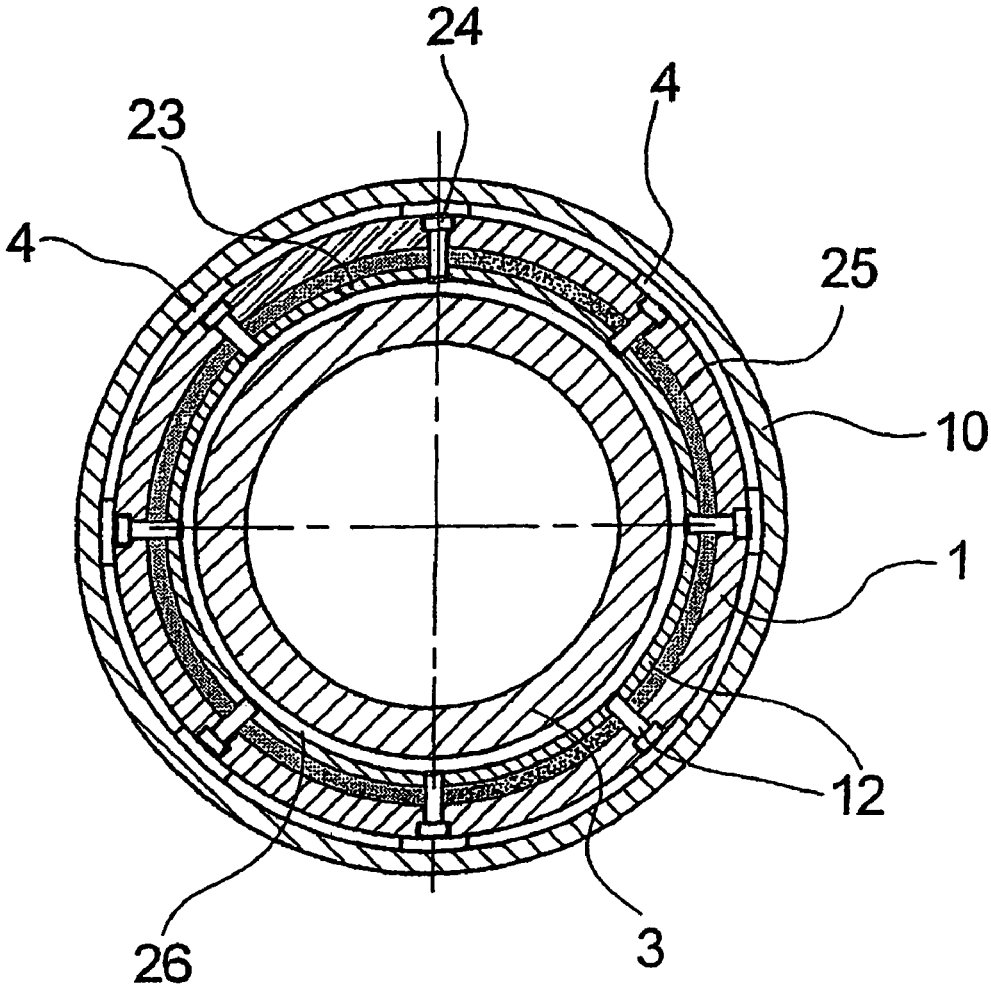
FIG. 2 is a schematic cross sectional view of the embodiment of FIG. 1.

To describe the support members 12, FIG. 2 schematically illustrates a cross section of the winding spindle shown in FIG. 1 in the region of the support point. Unless explicit reference is made to one of the Figures, the following description of the support members 12 applies to FIGS. 1 and 2.

The support members 12 are each formed by an annular support body 23 and a plurality of clamping elements 24 that are distributed over the circumference of the outer tube 1. The support body 23 is made deformable. In the embodiment of the support body 23 shown in FIG. 1, the support body 23 is formed by a special section ring.

The support body 23 is mounted on the inner tube 3. To produce a clamping force that is operative between the inner tube 3 and the outer tube 1, the clamping elements 24, which are formed by clamping screws, are screwed in from the outside through the outer tube 1 and connected to the support body 23. As a result, the support body 23 is stayed with the outer tube 1 and is thus deformed. The deformation of the support body 23 causes a radially operative clamping force to develop between the inner tube 3 and the outer tube 1. To achieve as much as possible a uniform action of the clamping force on the circumference of the outer tube 1, the support body 23 includes two elastic rings 25 extending parallel on its side facing the outer tube 1. Besides their supporting function, the elastic rings 25 assume at the same time a sealing function for sealing the annular space 26 against the openings that receive the clamping elements 24 in the outer tube 1.

As shown in FIG. 1, the outer tube 1 is stayed by means of the support members 12 with the inner tube 3 in a plurality of support points. In this embodiment of the winding spindle, each winding position, i.e., each mounting point of a winding tube 10 comprises a support point for staying the outer tube 1 with the inner tube 12. This makes the embodiment shown in FIG. 1 especially suitable for winding spindles projecting over a great length of more than one meter with the use of relatively wide winding tubes 10.

At the free end of the winding spindle, a cover 14 is connected by several screws 15 to the inner tube 3. The cover 14 is dimensioned such that it likewise closes the annular space 26 between the inner tube 3 and the outer tube 1.

At its opposite end, the inner tube 3 includes a peripheral collar 11, which engages the outer tube 1.

Figure 3:
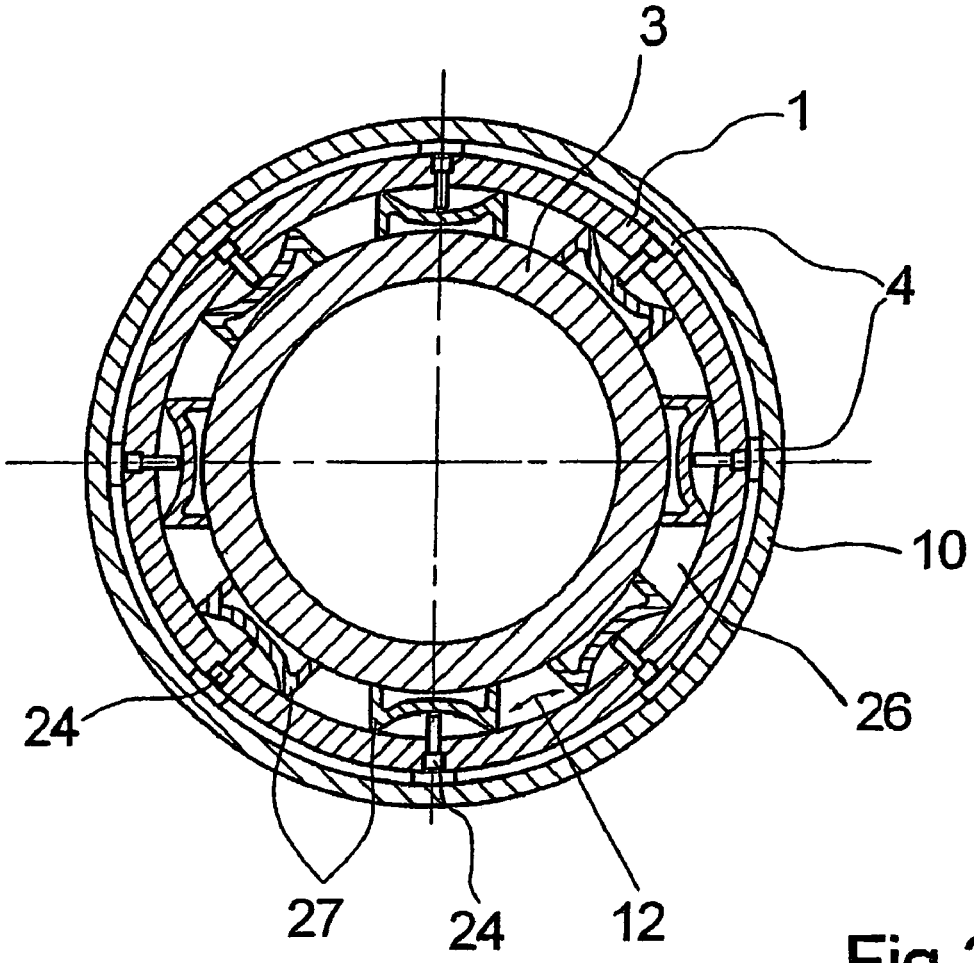
FIG. 3 is a cross sectional view of a further embodiment of a winding spindle according to the invention.

The support members 12 as shown in FIG. 1 are able to produce a clamping force between the outer tube 1 and the inner tube 3, after the outer tube 1 is slipped over the inner tube 3. FIG. 3 is a schematic cross sectional view of a further embodiment of a winding spindle according to the invention. This cross sectional view shows one of the plurality of support points of the winding spindle. Inside the support point, the support members 12 are formed by a plurality of segmental support bodies 27 that are evenly distributed over the circumference of the inner tube 3. Each support body 27 is constructed as a deformable special-section element. Each support body 27 is associated with a clamping element 24 in the form of a screw. To this end, the clamping element 24 is screwed through the outer tube and connected with the support body 27. In this process, the support body 27 is stayed with the outer tube 1 and deformed. The deformation of the segmental support body 27 produces a radially operative clamping force between the inner tube 3 and the outer tube 1. With that, a clamping force is produced that is unevenly operative on the circumference of the outer tube 1. The plurality of support bodies 27 arranged within a support point permits staying the inner tube 3 with the outer tube 1 in a reliable manner. Likewise, in this case the configuration of the segmental support bodies 27 and the clamping elements 24 is exemplary.

Figure 4:
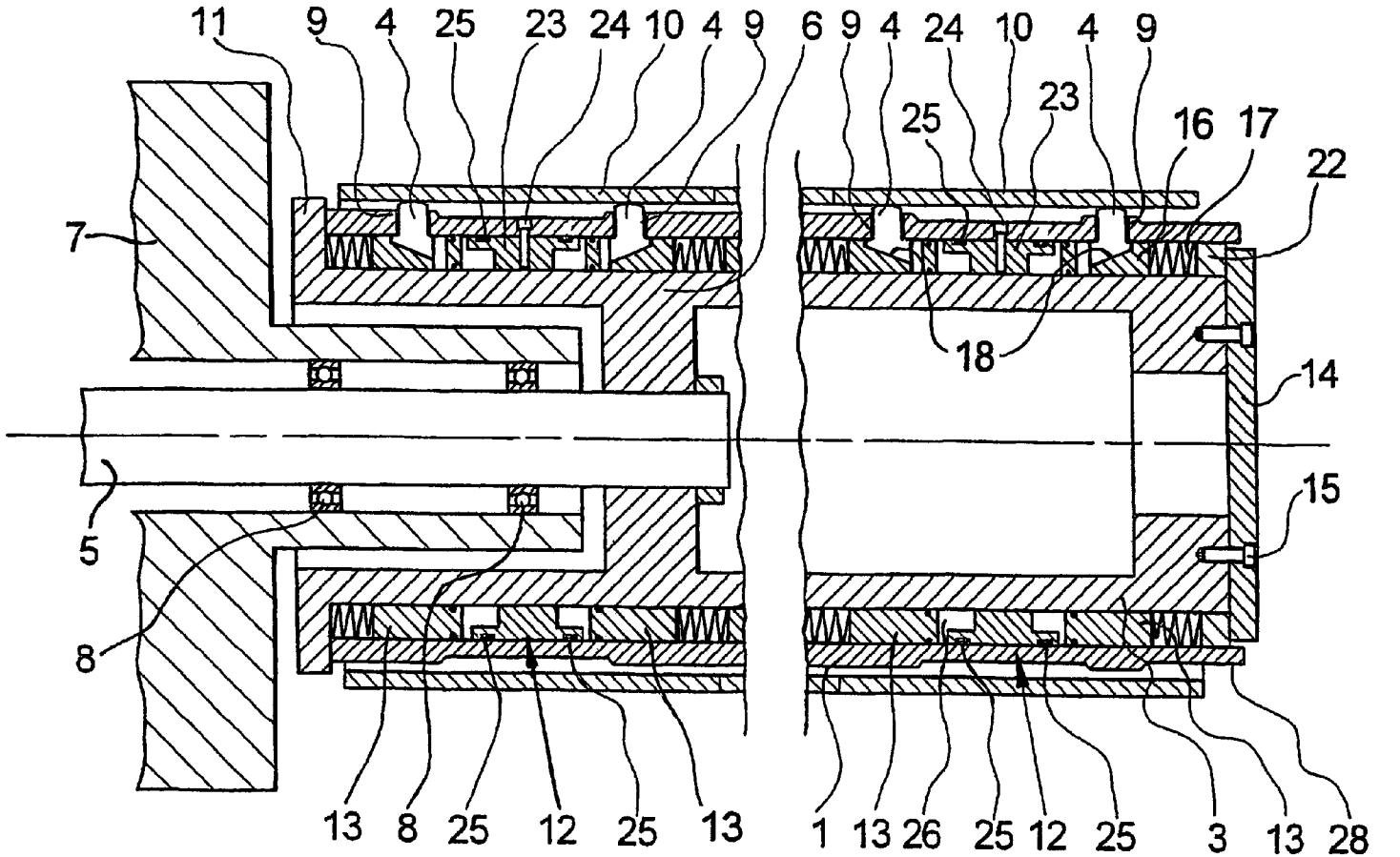
FIG. 4 is a schematic, axially sectioned view of a further embodiment of a winding spindle according to the invention.

FIG. 4 schematically illustrates a further embodiment of a winding spindle according to the invention. This embodiment is substantially identical with the foregoing embodiment of FIG. 1. To this extent, the description provided with reference to FIG. 1 is herewith incorporated, and only the differences are shown at this point.

In the embodiment of the winding spindle according to the invention and as shown in FIG. 4, the annular support bodies 23 are made T-shaped. Within a support point, the annular support body 23, which braces itself against the outer tube 1 via elastic rings 25, is connected to the outer tube 1 by a plurality of clamping elements 24. In this connection, a deformation is achieved with respect to the circular circumference of the annular support body 23. The annular support body 23 represents in its stayed condition a polygonal cross section, which leads in the annular space 26 to a clamping force that is operative between the inner tube 3 and the outer tube 1. With that, a clamping force is produced between the inner tube 3 and the outer tube 1, which is substantially evenly operative over the circumference.

To accelerate on the one hand as little masses as possible, and to obtain on the other hand a high flexural strength, in particular in the center region of the winding spindle, the outer tube possesses in each of its end regions a recessed portion 28. The recessed portion 28 is peripherally provided on the circumference of the outer tube 1. With that, the wall thickness of the outer tube 1 is made greater in the center region of the winding spindle than in the end regions of the outer tube 1.

Figure 5:
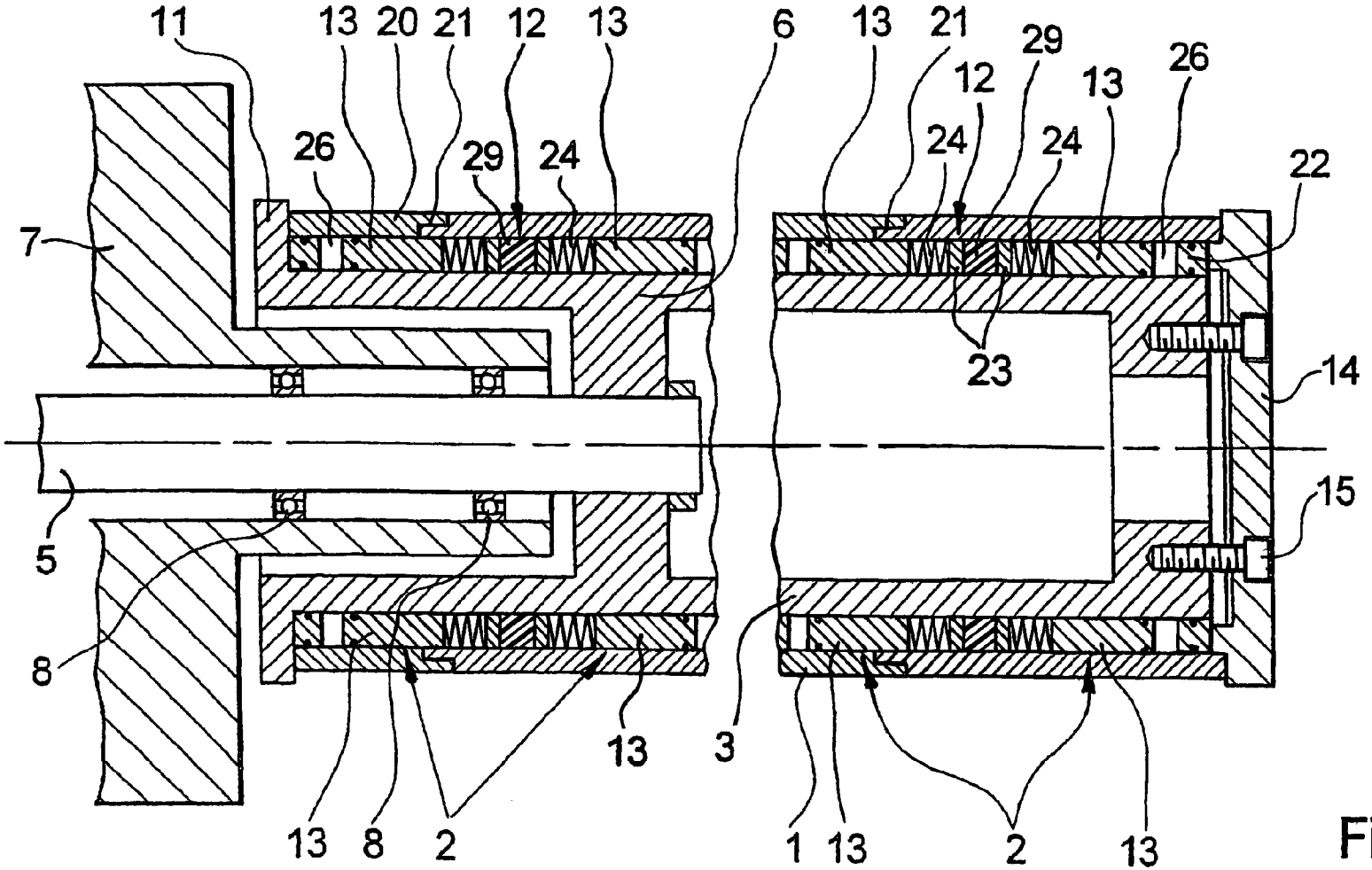
FIG. 5 is a schematic, axially sectioned view of a further embodiment of a winding spindle according to the invention.

FIG. 5 is an axially sectioned view of a further embodiment of a winding spindle according to the invention. This embodiment is likewise made substantially identical with the foregoing embodiment of FIG. 1, so that the description thereof is herewith incorporated by reference, and only the differences are shown at this point.

In the embodiment shown in FIG. 5, the outer tube 1 is formed by a column of successively arranged cylinders 20. Adjacent cylinders 20 engage each other in a joint 21 such that essentially no relative movement between cylinders is able to occur between the individual cylinders. As a result, the thus produced column of a plurality of cylinders 20 exhibits a flexural strength that is substantially equivalent to a continuous outer tube. Preferably, the joint 21 between cylinders 20 is made releasable. It would also be possible to make the joint 21 in a way (not shown) with the use of additional elements. Thus, a shrink ring extending over the joint between two cylinders 20 would provide an adequate flexural strength. However, there is also the possibility of keeping the connection of the cylinders flexible, and holding the cylinders together by an axial force. In addition, the cylinders may also be made different in their length, so that one or more longer cylinders are arranged in the center region, and one or more short cylinders in the end region. The inner tube 3 and the column of the cylinders 20 are stayed with each other. To this end, the inner tube 3 mounts a peripheral collar 11 at its end facing the support 7. Preferably, the collar 11 is made circular, and has an outside diameter, which extends beyond the outside diameter of the cylinders 20, so that the front end of the column of cylinders 20 abuts the inner side of the collar 11, which faces away from the support 7.

At their opposite ends, the inner tube 3 and column of cylinders 20 mount a cover 14. The cover 14 has an outside diameter that extends beyond the outside diameter of the cylinders 20. On its side facing the cylinder 20, the cover 14 has an annular contact surface, which directly abuts the front end of the cylinder column. Between the front end of the inner tube 3 and the cover 14, a gap is formed, through which a plurality of screws 15 extend, which connect the cover 14 to the front end of the inner tube 3. As a result, the inner tube 3 and the column of cylinders 20 are stayed with each other such that the clamping force produced in the inner tube 3 by the screws 15 leads via the contact surface of the cover 14, to a corresponding counterforce on the column of cylinders 20. The clamping force produced by the screw 15 leads to a tensile load of the inner tube 3. In the case of the column of cylinders 20, however, a compressive force is introduced by the contact surface of the cover 14 into the front end of the column. The column of cylinders 20 supports itself at the opposite end on collar 11 of the inner tube 3. With that, a closed flux of force develops between the inner tube 3 and the column of cylinders 20, so that the column of cylinders 20 and the inner tube 3 determine the load capacity and the flexural strength of the winding spindle.

In addition, a radial clamping is operative between the inner tube 3 and the cylinders 20. To this end, support members 12 are formed by an annular support body 23 positioned on each side of an elastomeric ring 29 and a pair of clamping elements 24 in the form of springs that act upon the support bodies 23. The clamping elements or springs 24 may assume at the same time the function of supporting the pistons that are arranged for displacement and form part of the tube mounting devices 13. The column arranged in the annular space 26 and comprising tube mounting devices 13 and support members 12 is stayed between the collar 11 and the cover 14 via the cover 14 that is screwed into the end of the inner tube 3. This causes the clamping elements or springs 24 to produce a compressive load on the respective elastomeric ring 29, so that the deformation of the ring 29 produces a radially operative clamping force between the inner tube 3 and the respective cylinder 20. With that the column of cylinders 20 is connected to the inner tube 3 by a radial clamping force in the support points and by an axial staying via the cover 14.

In each of the illustrated embodiments of the winding spindle shown in FIGS. 1, 4, and 5, a plurality of support points are provided for staying the inner tube with the outer tube in the radial direction. It has shown that with a length of the winding spindle of one meter, it is necessary to have at least three support points in spaced relationship with, for example, annular support members, for purposes of obtaining an adequate load capacity of the outer tube. To increase the flexural strength, it is also possible to use a special-section outer tube. In this connection, the outer tube possesses an internal, axially extending special-section shape, which makes it possible to reduce wall thicknesses and to have thus less mass in the outer tube, without substantially decreasing the rigidity.

The winding spindle of the present invention distinguishes itself in particular in that the inner tube and the outer tube are easy to assemble. During the assembly, the support bodies are not deformed. They are held on the circumference of the inner tube. Only after completing the assembly is the outer tube stayed with the inner tube by a deformation of the support bodies.

What is claimed is:

1. A winding spindle for mounting a plurality of yarn winding tubes on a yarn winding machine, comprising a rotatable inner tube connected for corotation to a drive shaft, an outer tube coaxially surrounding the inner tube in spaced relationship, with the inner tube and the outer tube being connected for corotation, a clamping device arranged between the inner tube and the outer tube and including a plurality of clamping elements positioned to extend through openings in the outer tube for engaging the interior of yarn winding tubes which are coaxially mounted on the spindle, a plurality of support members arranged between the inner tube and the outer tube in an axially spaced apart arrangement for producing a radially operative clamping force between the inner tube and the outer tube which is sufficient to increase the natural resonant frequency of the winding spindle, and wherein each support member is formed by a deformable support body and at least one clamping element which is in engagement with the support body, with the clamping force being producible by the interengagement of the support body and the clamping element.

2. The winding spindle of claim 1, wherein the support body is annular, so that the clamping force is operative substantially continuously on the circumference between the outer tube and the inner tube.

3. The winding spindle of claim 1, wherein the support body is segmental, so that the clamping force is operative at spaced locations on the circumference between the outer tube and the inner tube.

4. The winding spindle of claim 1, wherein the support body is held on the inner tube, and the clamping element is formed by one or more evenly distributed clamping screws, which act upon the support body from the outside through the outer tube.

5. The winding spindle of claim 1, wherein the support body mounts on its circumference at least one elastic ring, by which the support body is supported relative to the outer tube.

6. The winding spindle of claim 1, wherein the ratio of the length L of the winding spindle to the diameter D of the winding spindle is in a range of $L/D>10$.

7. The winding spindle of claim 6, wherein the inner tube and the outer tube extend over a length of at least one meter, and they are stayed by at least three annular support members which are arranged in an axially spaced relationship.

8. The winding spindle of claim 1, wherein the clamping device comprises a plurality of axially spaced apart pairs of tube mounting devices, with the tube mounting devices of each pair each mounting a plurality of the clamping elements so as to extend in a radial direction, and wherein between each pair of tube mounting devices at least one of the support members is arranged.

9. The winding spindle of claim 8, wherein each pair of tube mounting devices and the at least one of the support members define a mounting point for mounting a winding tube.

10. A winding spindle for mounting a plurality of yarn winding tubes on a yarn winding machine, comprising a rotatable inner tube connected for corotation to a drive shaft, an outer tube coaxially surrounding the inner tube in spaced relationship, with the inner tube and the outer tube being connected for corotation, a clamping device arranged between the inner tube and the outer tube and including a plurality of clamping elements positioned to extend through openings in the outer tube for engaging the interior of yarn winding tubes which are coaxially mounted on the spindle, a plurality of support members arranged between the inner tube and the outer tube in an axially spaced apart arrangement for producing a radially operative clamping force between the inner tube and the outer tube, and wherein the outer tube comprises in each of its end regions one or more externally recessed portions, so that the wall thickness in the center region of the outer tube is greater than in the region of the recessed portions.

11. A winding spindle for mounting a plurality of yarn winding tubes on a yarn winding machine, comprising a rotatable inner tube connected for corotation to a drive shaft, an outer tube coaxially surrounding the inner tube in spaced relationship, with the inner tube and the outer tube being connected for corotation, a clamping device arranged between the inner tube and the outer tube and including a plurality of clamping elements positioned to extend through openings in the outer tube for engaging the interior of yarn winding tubes which are coaxially mounted on the spindle, a plurality of support members arranged between the inner tube and the outer tube in an axially spaced apart arrangement for producing a radially operative clamping force between the inner tube and the outer tube, wherein the support members are elastically deformable and are arranged for selective movement between a relaxed position wherein the support members do not appreciably engage the outer tube and a deformed position wherein a radially operative clamping force is produced between the inner and outer tubes, and wherein each support member includes at least one adjustable clamping element by which the support member is moveable between the relaxed and deformed positions, to thereby facilitate the assembly of the inner and outer tubes when the support members are in their relaxed position.

* * * * *